US009359681B1

(12) United States Patent
Serov et al.

(10) Patent No.: US 9,359,681 B1
(45) Date of Patent: Jun. 7, 2016

(54) $CO_2$ ELECTROREDUCTION ON METALS AND METAL ALLOYS PREPARED BY A SACRIFICIAL SUPPORT-BASED METHOD

(71) Applicants: Alexey Serov, Albuquerque, NM (US); Plamen B Atanassov, Santa Fe, NM (US); Monica Padilla, Albuquerque, NM (US)

(72) Inventors: Alexey Serov, Albuquerque, NM (US); Plamen B Atanassov, Santa Fe, NM (US); Monica Padilla, Albuquerque, NM (US)

( * ) Notice: Subject to any disclaimer, the term of this patent is extended or adjusted under 35 U.S.C. 154(b) by 0 days.

(21) Appl. No.: 14/204,606

(22) Filed: Mar. 11, 2014

Related U.S. Application Data

(60) Provisional application No. 61/776,317, filed on Mar. 11, 2013.

(51) Int. Cl.

| | |
|---|---|
| ***B22F 9/18*** | (2006.01) |
| ***C25D 1/08*** | (2006.01) |
| *B22F 9/30* | (2006.01) |
| *B22F 9/24* | (2006.01) |
| *B22F 9/04* | (2006.01) |
| *B22F 9/20* | (2006.01) |

(52) U.S. Cl.
CPC ... *C25D 1/08* (2013.01); *B22F 9/18* (2013.01); *B22F 9/20* (2013.01); *B22F 9/24* (2013.01); *B22F 9/30* (2013.01); *B22F 2009/043* (2013.01)

(58) Field of Classification Search
CPC ..... B22F 9/18; B22F 9/20
See application file for complete search history.

(56) References Cited

U.S. PATENT DOCUMENTS

| | | | | |
|---|---|---|---|---|
| 3,962,139 | A * | 6/1976 | van de Moesdijk et al. | 502/215 |
| 4,186,110 | A * | 1/1980 | Jalan et al. | 502/101 |
| 4,713,110 | A * | 12/1987 | Bogdanovic et al. | 75/370 |
| 2003/0187294 | A1* | 10/2003 | Hagemeyer et al. | 560/241 |
| 2005/0079374 | A1* | 4/2005 | Asai | 428/613 |
| 2006/0137487 | A1* | 6/2006 | McKinnon et al. | 75/252 |
| 2012/0219735 | A1* | 8/2012 | Bakker et al. | 428/34.1 |

* cited by examiner

*Primary Examiner* — George Wyszomierski
*Assistant Examiner* — Ngoclan T Mai
(74) *Attorney, Agent, or Firm* — Gonzales Patent Services; Ellen Gonzales

(57) ABSTRACT

Novel porous metal and metal alloy materials for electroreduction of $CO_2$ and methods for making the same.

17 Claims, 14 Drawing Sheets

$CO_2$ ELECTROREDUCTION ON METALS AND METAL ALLOYS PREPARED BY A SACRIFICIAL SUPPORT-BASED METHOD

CROSS-REFERENCE TO RELATED APPLICATIONS

The following application claims benefit of U.S. Provisional Application No. 61/776,317, entitled "CO2 Electroreduction on Metals and Metal Alloys Prepared by SSM," filed Mar. 11, 2013, which is hereby incorporated by reference in its entirety.

BACKGROUND

Carbon dioxide is a greenhouse gas with rapidly increasing atmospheric presence and CO2 emission into the atmosphere is a main factor leading to global warming. However, carbon dioxide can be chemically reduced into useful products, including carbon and carbon-based fuels. Unfortunately current methods for electrochemical reduction of $CO_2$ typically have an energy conversion efficiency of between 5 and 30%, making most mechanisms non-viable from a commercial perspective. See e.g., Hori, Y. Modern Aspects of Electrochemistry, Number 42, edited by C. Vayenas et al., Springer, New York, 2008. In general, this inefficiency is at least partially caused by the low activity and selectivity of the electrocatalysts and the low solubility of $CO_2$ in any solvents.

Accordingly, workable and cost effective mechanisms for chemical fixation and reduction of carbon dioxide are desirable as they both help to reduce atmospheric greenhouse gasses and provide an abundant and environmentally friendly supply of carbon for commercial uses including, but not limited to, carbon-based fuels.

SUMMARY

In the present disclosure, novel metal/metal-alloy materials for use in $CO_2$ electroreduction reactions and a method of preparation the same is described. The method utilizes a sacrificial support-based approach and results in a metal-based material having a specific, desirable morphology that is capable of both trapping $CO_2$ and increasing the likelihood that $CO_2$ exposed to the supports will interact with active sites present on the supports.

According to another embodiments, the present disclosure provides a method of preparation of the above-described supporting materials further utilizing a mechanosynthesis-based approach that enables, though does not require, the utilization of nonsoluble materials.

According to yet another embodiment, the methods described herein can be used to form and produce nanoreactors, that is, powders formed from nano-sized particles that are specifically engineered to both trap $CO_2$ and increase the likelihood that $CO_2$ exposed to the nanoreactors will interact with active sites present on the supports.

DETAILED DESCRIPTION

Figure 1:
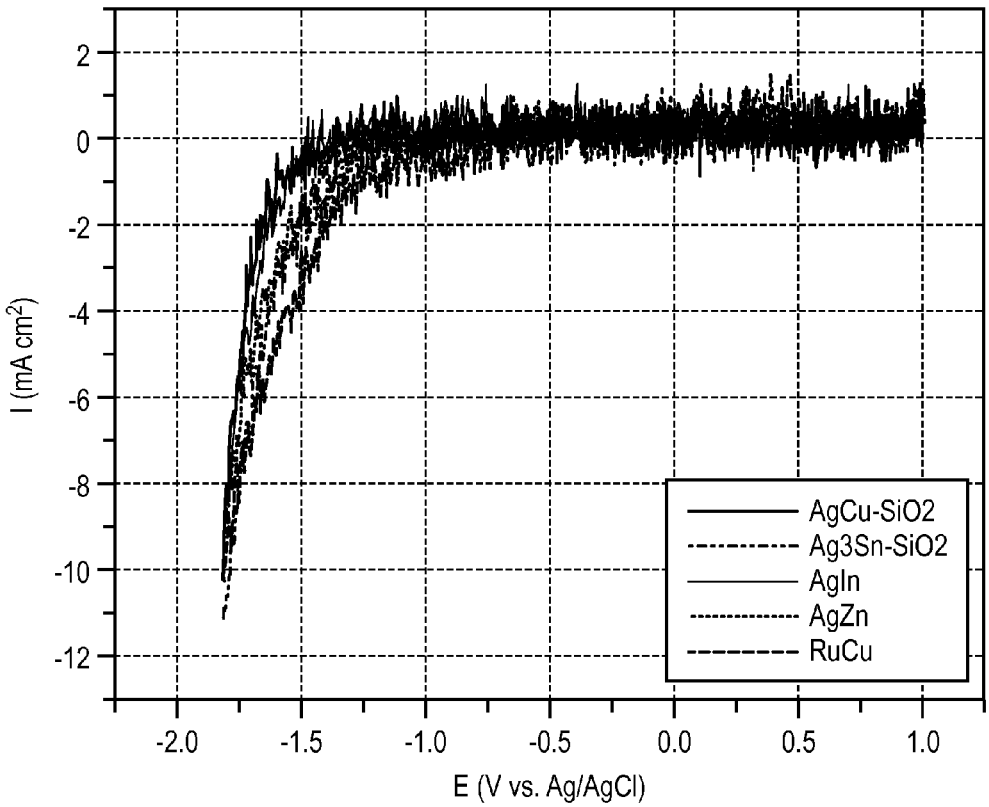
FIG. 1 is a graph showing electroreduction on a variety of metal alloys.

According to an embodiment, the present disclosure provides novel metal and/or metal alloy materials and methods for making the same. The present disclosure provides a sacrificial template-based method and a combined mechanosynthesis/sacrificial template-based method that enables the production of metal and metal alloy materials having a complex porous morphology and which may or may not include insoluble materials. According to various embodiments, the metal and/or metal alloy material may be used as a $CO_2$ trap and/or as an active support and/or catalyst in $CO_2$ electroreduction reaction. In some cases, the metals or metal alloys are selected to produce a catalyst that enables the production of a specific carbon based fuel as the product of a $CO_2$ electroreduction reaction.

For the purposes of the present disclosure, the terms "support" or "supporting material" is used to describe a physical structure on which one or more chemicals, biologicals, or other structures is or can be situated. In general, in this arrangement the support typically provides some or all of the three-dimensional structure and morphology for the resulting product. Accordingly, a support or supporting material may take any shape or shapes that are useful for the desired product, including, but not limited to particles, beads, cubes, cubits, amorphous shapes, regular or irregular shapes, which may form a specifically sized or shaped substrate, layer, overlayer, insert, etc. While supports in general may be either porous or non-porous, various embodiments taught herein describe methods for producing porous supports. Moreover, supports may range from the nanoparticle range to large structures, depending entirely on the intended use of the final product.

For example, a supporting material may provide a physical structure on which catalytic materials are situated, so as to produce a catalyst. In this example, the supporting material typically enables both the dispersion and connectivity of the catalytic materials. That is, the catalytic material may be physically spread out over the surface or throughout the supporting material, which may also provide electrical connectivity with the outside world (that is, the support either enables or provides electrical conductivity with structures, materials, etc. that form neither the support nor the catalytic material.) An "active support" is a support that includes or is formed from material that is able to both provide the structural support and electrical connectivity described above, and display an active site which enables and takes part in catalysis.

For the sake of clarity, in the present application the term "catalyst" is used to refer to a final product, which catalyzes a desired reaction, including, for example, the type of electrocatalytic reactions that are used in various types of fuel cells. The catalyst may include multiple types of materials, including, for example, catalytic materials, supporting materials (active or inactive), etc.

For the purposes of the present disclosure, the term "catalytic material" is any material which contains an active site that enables catalysis. Examples of catalytic materials include active supports and platinum group metals.

For the purposes of the present disclosure, the term "active site" is used to describe chemical species on the surface of the catalyst and/or active support that participate in the catalyzed reaction. It will be understood that different types of active sites may use different types of catalytic pathways. For example, some active sites follow a 4 electron (4 e) pathway, while other follow a 2 electron (2 e) pathway. Examples of catalytic materials having active sites that follow the 4 e pathway include Pt, Pd, RuSe, and PdSe. Examples of catalysts having active sites that follow the 2 e pathway include MoSe, nitrogen-doped carbons, and CNTs.

According to a more specific example, a metal or metal-alloy support according to the present disclosure may be synthesized utilizing a sacrificial template-based method. For the purposes of the present disclosure, the term "sacrificial template" is intended to refer to a material that is included during the synthesis process in order to provide temporary structure but which is mostly or entirely removed during the synthesis process. According to one embodiment of this particular method, sacrificial template particles are coated, infused, or otherwise mixed with a metal salt under suitable conditions to produce a sacrificial template particle—infused metallic material. If an alloy is to be produced, the sacrificial template particles are mixed with metal salts of the different metals to be alloyed, at the desired ratio. The infused material is then subjected to heat treatment, such as pyrolysis to form a rigid three-dimensional structure containing sacrificial template particles. The sacrificial template particles are then removed, resulting in a porous three-dimensional structural support wherein the pores are the voids that are produced by the removal of the template particles.

According to some embodiments, the metal salts and sacrificial templates may be mixed together under aqueous conditions using known solvents such as water, alcohols, or the like and using various known mechanical mixing or stirring means under suitable temperature, atmospheric, or other conditions as needed in order to dissolve, mix, or alloy the selected materials, as desired. Suitable mixing means include, for example, use of an ultrasound bath, which also enables dispersion of the starting materials, shear mixer etc.

According to other embodiments the metal salts and sacrificial template particles may be mixed together using mechanosynthesis techniques such as ball-milling, which do not necessarily require solvents. Of course it will be appreciated that while the method does not require the addition of solvents, solvents may be used, if desired. For the purposes of the present disclosure, the term "ball mill" is used to refer to any type of grinder or mill that uses a grinding media such as silica abrasive or edged parts such as burrs to grind materials into fine powders and/or introduce to the system enough energy to start a solid state chemical reaction that leads to the formation of a catalyst. In general, for the purposes of the present disclosure, the ball mill used should be capable of producing enough energy to initiate the desired chemical reaction or achieve the desired level of mixing.

As stated above, according to some embodiments, the entire process is performed dry, by which is meant, without the presence of any added solvents. According to one embodiment of a solvent-free process, all initial materials (i.e. the metal salts and sacrificial support particles) are combined in a ball mill in powder form and the entire process is conducted without the addition of any liquids. For the purposes of the present disclosure, a powder is a dry, bulk solid composed of a large number of very fine particles that may flow freely when shaken or tilted. Because the method can be practiced without the presence of any solvents, the method enables the synthesis of supports formed from insoluble materials. Examples of insoluble materials which can be used to form supports according to the present disclosure include, but are not limited to metal sulfides, carbides, nitrides, oxides etc.

If the mixing process involves solvents, the mixture is then dried to form a dry composite material. The dry composite material (whether formed using a wet or dry technique), can then be ground or otherwise treated or shaped and then heat treated before removal of the sacrificial template particles. According to some embodiments it may be desirable to produce a powder including or formed exclusively of particles in the nanometers size range. Accordingly, the dry composite material may be ground or otherwise treated to produce particles in the 1-500 nm size range. If it is desirable to produce a powder formed exclusively from particles in a particular size range, various sorting mechanisms including sieving, electrostatic separation, or the like may be employed.

Suitable metals include Ti, V, Cr, Mn, Fe, Co, Ni, Cu, Zn, Y, Zr, Nb, Mo, Ru, Rh, Pd, Ag, Cd, In, Sn, Sb, Hf, Ta, W, Os, Ir, Pt, Au, Tl, Pb, Bi, La, Ce, Pr, Nd, and alloys thereof. Exemplary metal salts include, but are not limited to $M_x(NO_3)_y$, $M_xCl_y$, $M_x(SO_4)_y$ (where M=Ti, V, Cr, Mn, Fe, Co, Ni, Cu, Zn, Y, Zr, Nb, Mo, Ru, Rh, Pd, Ag, Cd, In, Sn, Sb, Hf, Ta, W, Os, Ir, Pt, Au, Tl, Pb, Bi, La, Ce, Pr, Nd). In general, the metal or metals used will be determined by the intended use of the final product. If the product is to be used for electroreduction of $CO_2$, the specific metal or metal alloy may be selected to produce the desired product of the electroreduction reaction. The Hori reference, which is incorporated by reference above, includes a number of tables identifying various carbon fuel products produced by the electroreduction of $CO_2$ on various metals based on the set ups described therein. For example, Pb, Hg, In, Sn, Cd, Tl, and Bi are described as producing formate ion as their major product; Au, Ag, Zn, Pd, and Ga, are described as producing CO as their major product; Cu is described as producing $CH_4$, $C_2H_4$ and alcohols in quantitatively reproducible amounts; and while Ni, Fe, Pt, and Ti, are described as not practically giving a continuous product from $CO_2$, they are described as enabling hydrogen evolution. Furthermore, Cu—Ni, Cu—Fe, and CuCd alloys are described as producing $CH_4$, $C_2H_4$, and CO; Cu—Ni, Cu—Sn, Cu—Pb, Cu—Zn, and Cu—Cd alloys are described as producing $HCOO^-$ and CO; Cu—Au alloy is described as producing $CH_4$, $C_2H_4$, $HCOO^-$, EtOH, and PrOH-1; and Cu-AG alloy is described as producing CO, $C_2H_4$, $CH_3CHO$, and $C_2H_3OH$. It will be appreciated that the various products of the electroreduction of $CO_2$ can be altered based on the conditions of the reaction as well, for example by selecting aqueous or nonaqueous electrolytes, elevating or decreasing pressure, or temperature. Those of skill in the art will be familiar with Hori or other reference which can provide guidance as to the specific metal or metal alloy and electroreduction conditions that can be used to produce the desired product(s). However, it should be appreciated that the presently disclosed methods for forming the metal materials described herein enables additional tailoring of the electroreduction reaction, as the methods enable the production of supporting materials having a highly controllable morphology. Specifically, by selecting the ratio of sacrificial template particles to metal and the size, shape, and even porosity, of the sacrificial template particles, it is possible to both control, select, and fine-tune the internal structure of the final product material. In essence, the disclosed method enables the production of a metallic sponge having as convoluted and tortuous an internal structure as desired. For example, a highly porous open-structure "sponge" may be formed by using larger sacrificial template particles, while a highly convoluted, complex internal structure may be formed by using smaller, more complexly shaped, sacrificial particles, including for example, sacrificial particles of different shapes and/or sacrificial particles which are themselves porous. Moreover, the "density" of the sponge can be selected by altering, for example, the ratio of sacrificial particles to metal salts, the shape of the template particles (i.e. how easily they fit together), or other factors.

Accordingly, it will be appreciated that the size and shape of the sacrificial template particles may be selected according to the desired shape(s) and size(s) of the voids within the final catalyst product. Specifically, it will be understood that by selecting the particular size and shape of the template particles, one can produce an electrocatalyst having voids of a predictable size and shape. For example, if the template particles are spheres, the electrocatalyst will contain a plurality of spherical voids having the same general size as the spherical template particles. For example, assuming there is no alteration in the size of the particle caused by the synthesis method, in an embodiment where particles having an average diameter of 20 nm is used, the spherical voids in the metal material will typically have an average diameter of approximately 20 nm (Those of skill in the art will understand that if the diameter of the particle is 20 nm, the internal diameter of the void in which the particle resided will likely be just slightly larger than 20 nm and thus the term "approximately" is used to account for this slight adjustment.)

Accordingly it will be understood that the template particles may take the form of any two- or three-dimensional regular, irregular, or amorphous shape or shapes, including, but not limited to, spheres, cubes, cylinders, cones, etc. The particles may be monodisperse, or irregularly sized. Furthermore, it will be understood that because the supporting materials are formed using a sacrificial template technique, where the sacrificial material can be, for example, "melted" out of the supporting materials using acid etching or other techniques, the resulting material can be designed to have a variety of variously shaped internal voids which result in an extremely high internal surface area that is accessible to, for example, CO2 or other gasses, liquids, elements, compounds, etc. that are exposed to the metal or metal alloy material. Furthermore, because the size and shape of the voids is created by the size and shape of the sacrificial particles, supporting materials having irregular and non-uniform voids can easily be obtained, simply by using differently shaped sacrificial particles and/or by the non-uniform distribution of sacrificial materials within the metal salt/sacrificial template particle mixture.

As stated above, according to various embodiments, sacrificial particles of any size or diameter may be used. In some preferred embodiments, sacrificial particles having a characteristic length/diameter/or other dimension of between 1 nm and 100 nm may be used, in more preferred embodiments, sacrificial particles having characteristic length/diameter/or other dimension of between 100 nm and 1000 nm may be used and in other preferred embodiments, sacrificial particles having characteristic length/diameter/or other dimension of between 1 nm and 10 nm, or 5 nm and 20 nm, or 5 nm and 40 nm, or 20 nm and 80 nm, may be used. It should also be understood that the term "sacrificial particle" is used herein as a term of convenience and that no specific shape or size range is inherently implied by the term "particle" in this context. Thus while the sacrificial particles may be within the nanometers sized range, the use of larger or smaller particles is also contemplated by the present disclosure.

According to some embodiments, the sacrificial particles may themselves be porous. Such pores may be regularly or irregularly sized and/or shaped.

It will be appreciated that the sacrificial template particles may be synthesized and mixed (or coated, or infused, etc.) in a single synthesis step or the metal salts may be mixed with pre-synthesized (whether commercially purchased or previously synthesized) sacrificial particles. The metal salt/sacrificial template mixture is then subjected to heat treatment, (such as pyrolysis) in an inert ($N_2$, Ar, He, etc.) or reactive ($NH_3$, acetonitrile, etc.) atmosphere.

Of course it will be appreciated that given the various conditions that the sacrificial template will be subjected to during the synthesis process, it is important to select a template material which is non-reactive to the catalytic materials under the specific synthesis conditions used and the removal of which will not damage the final material. For example, if the supporting is to be an active support, it is important that the method(s) used to remove the sacrificial particles not damage the support's active sites. Silica is a material which is known to easily withstand the conditions described herein while remaining inert to a variety of catalytic materials including the metals described herein. Furthermore, silica can be removed using techniques that are harmless to the support's active sites. Thus, silica is considered to be a suitable material from which the sacrificial template particles can be made. According to some specific embodiments, 20 nm diameter spheres formed from mesoporous silica can be used. In this case the templating involves intercalating the mesopores of the silica template particles and the resulting material typically contains pores in the 2-20 nm range. In one particular embodiment, the silica template is commercially available Cabosil amorphous fumed silica (325 $m^2/g$). Those of skill in the art will be familiar with a variety of silica particles that are commercially available, and such particles may be used. Alternatively, known methods of forming silica particles may be employed in order to obtain particles of the desired shape and/or size.

However, while many of the examples herein utilize silica for the templating materials, it will be appreciated that other suitable materials may be used including, but are not limited to, zeolites, aluminas, and the like.

As stated above, after the metal salts are mixed with the sacrificial support, the resulting material is heat treated. Heat treatment may be performed either in an inert atmosphere such as $N_2$, Ar, or He, or in a reactive atmosphere such as $NH_3$ or acetonitrile. Inert atmospheres are typically used when the M-N—C materials are nitrogen rich, as the inert atmosphere enables the production of a high number of active sites with Fe (or other metal) $N_4$ centers. However, it may be desired to use a nitrogen rich atmosphere if the M-N—C material is rich in carbon and depleted in nitrogen, as the nitrogen rich atmosphere will enable production of the Fe (or other metal) $N_4$ centers.

According to some embodiments, optimal temperatures for heat treatment are typically between 100 C and 1100 C. According to some embodiments, heat treatment may preferably be between 300 C and 600 C. In some embodiments, heat treatment of around 450 C is preferred (see experimental section below).

After heat treatment, the sacrificial template particles are removed resulting in a porous, metal or metal-alloy material. In some cases the metal or metal-alloy material consists only of materials derived from the metal salts. Removal of the sacrificial template particles may be achieved using any suitable means. For example, the template particles may be removed via chemical etching. Examples of suitable etchants include NaOH, KOH, and HF. According to some embodiments, it may be preferable to use KOH, as it preserves all metal and metal oxide in the material and, use of KOH may, in fact, increase catalytic activity of the active centers. Alternatively, in some embodiments, HF may be preferred as it is very aggressive and can be used to remove some poisonous species from the surface of the support. Accordingly, those of skill in the art will be able to select the desired etchants based on the particular requirements of the supporting material being formed.

The presently described metal or metal alloy supports can also be synthesized using a double heat treatment procedure. In this procedure, the metal salts are mixed with the sacrificial template, and then subjected to a first heat treatment step in order to decompose the initial materials. The intermediate material is then subjected to a second heat treatment step in order to reduce the materials. After the second heat treatment, the sacrificial template is removed using chemical etching or other suitable means as described above.

In embodiments utilizing a two-step procedure, and therefore, two separate heat treatment steps, it may desirable for the different heat treatment steps to be conducted under different conditions, for example at different temperatures and/or for different durations of time. For example, the first heat treatment step may be performed at 100 (degrees C.) for 1 h (time) and the second heat treatment step may be performed at 500 (degrees C.) for 4 h (time).

According to some embodiments, it may be desirable to produce large numbers of supports as described herein. High production yield may be produced, for example, by implementing a batch-wise process. Accordingly, the present disclosure further provides a method for large-scale preparation of the presently described active supports. According to an embodiment, the present disclosure provides a method which combines a sacrificial template-based methodology with spray pyrolysis to produce active catalyst supports. According to this method, the spray pyrolysis method is a continuous method while the sacrificial template-based methodology is performed batch-wise. According to an exemplary method, the metal salts described herein are mixed with sacrificial template particles, the mixture is atomized, and the resulting droplets dried in a tube furnace. The powder obtained from this procedure is then collected on a filter. The collected powder is then heat treated. Finally, the template material is removed, for example by leaching with KOH or HF.

According to some embodiments, the present disclosure provides supports decorated with catalytic materials such as, but not necessarily limited to, Pt, Pt alloys, PdM, platinum group metals, transition metals and their carbides, nitrides, oxides and chalcogenides, RuCh, and MCh (where M is a transition metal and Ch is S, Se, and/or Te). These catalytic materials can be decorated, deposited or otherwise attached to the support by various means suitable to the type of catalytic material selected and the materials used to form the active support. For example, platinum and platinum group metals may be attached to the support by vapor deposition, chemical and thermal reduction methods, atomic layer deposition, sputtering, etc.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. The methods and processes illustratively described herein suitably may be practiced in differing orders of steps, and that they are not necessarily restricted to the orders of steps indicated herein or in the claims. As used herein and in the appended claims, the singular forms "a," "an," and "the" include plural reference unless the context clearly dictates otherwise. Thus, for example, a reference to "a catalyst" includes a plurality of such catalysts, and so forth.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

All patents and publications referenced below and/or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

Additional information may be gathered from the Examples section below.

EXAMPLES

I. Synthesis of Indium Support 52.4 g of indium chloride dissolves in 660 ml of water. 22.5 g of silica is added to solution and dispersed using ultrasound bath. Mixture allows to dry at T=50 C for 4 hours, then T=115 for 24 hours. As prepared dry composite materials is ground and heat treated at hydrogen at T=195 C. The silica is removed by 4M KOH for 2 hours. As results indium powder was washed by DI water until neutral reaction and dried at T=85 C for 48 hours.

Figure 2:
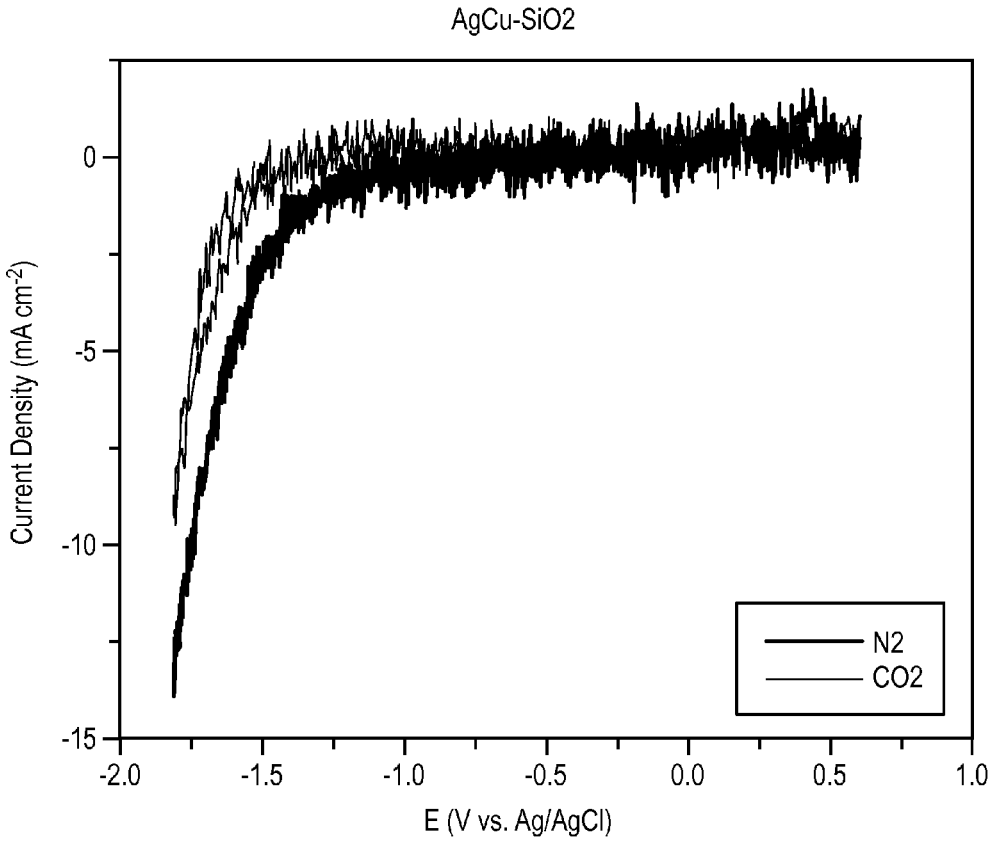
FIG. 2 is a cyclic voltammagram of AgCu—$SiO_2$.

II. Synthesis of AgCu Support 12.4 g of silver nitrate and 23.12 g of copper nitrate dissolves in 900 ml of water. 12.5 g of silica is added to solution and dispersed using ultrasound bath. Mixture allows to dry at T=50 C for 4 hours, then T=115 for 24 hours. As prepared dry composite materials is ground and heat treated at hydrogen at T=495 C. The silica is removed by 4M KOH for 2 hours. As results catalyst powder was washed by DI water until neutral reaction and dried at T=85 C for 48 hours. FIG. 1 is a graph showing electroreduction on a variety of metal alloys including AgCu prepared as described above. FIG. 2 is a cyclic voltammagram of AgCu—SiO2. Conditions: 202 μg·cm−2 0.5 M $NaCO_3$, 1600 RPM, 25° C., 20 mV·$s^{-1}$.

Figure 3:
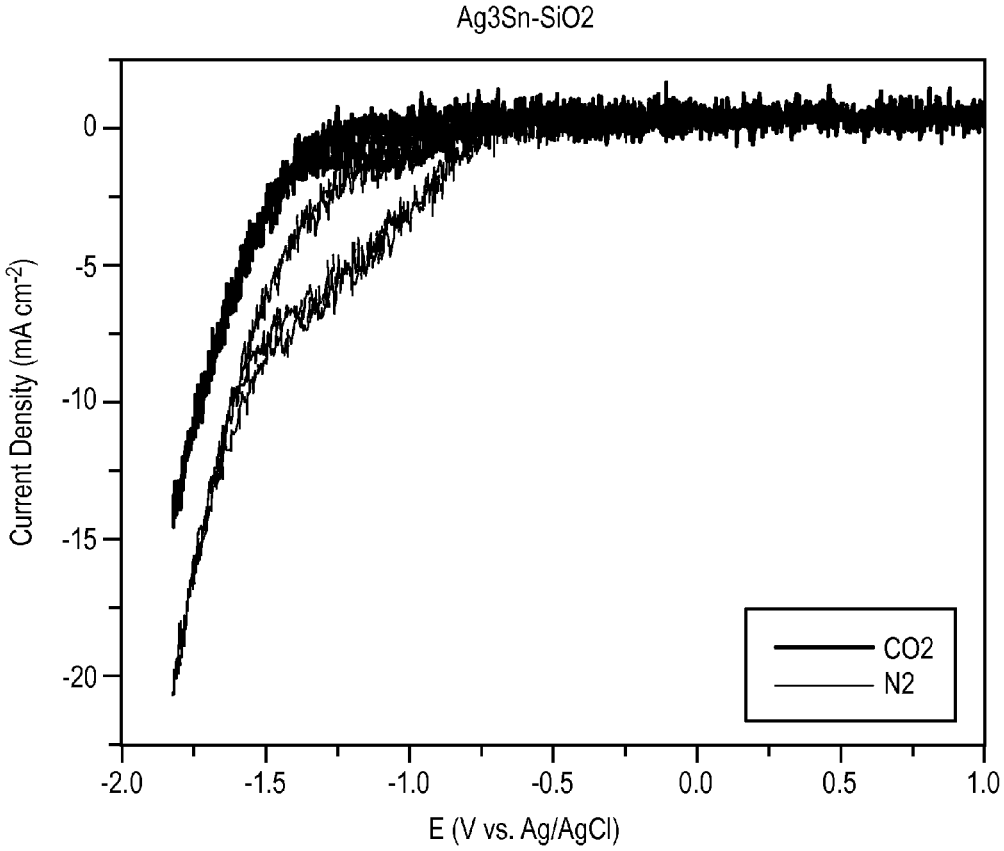
FIG. 3 is a cyclic voltammogram of Ag3Sn—SiO2.
Figure 4:
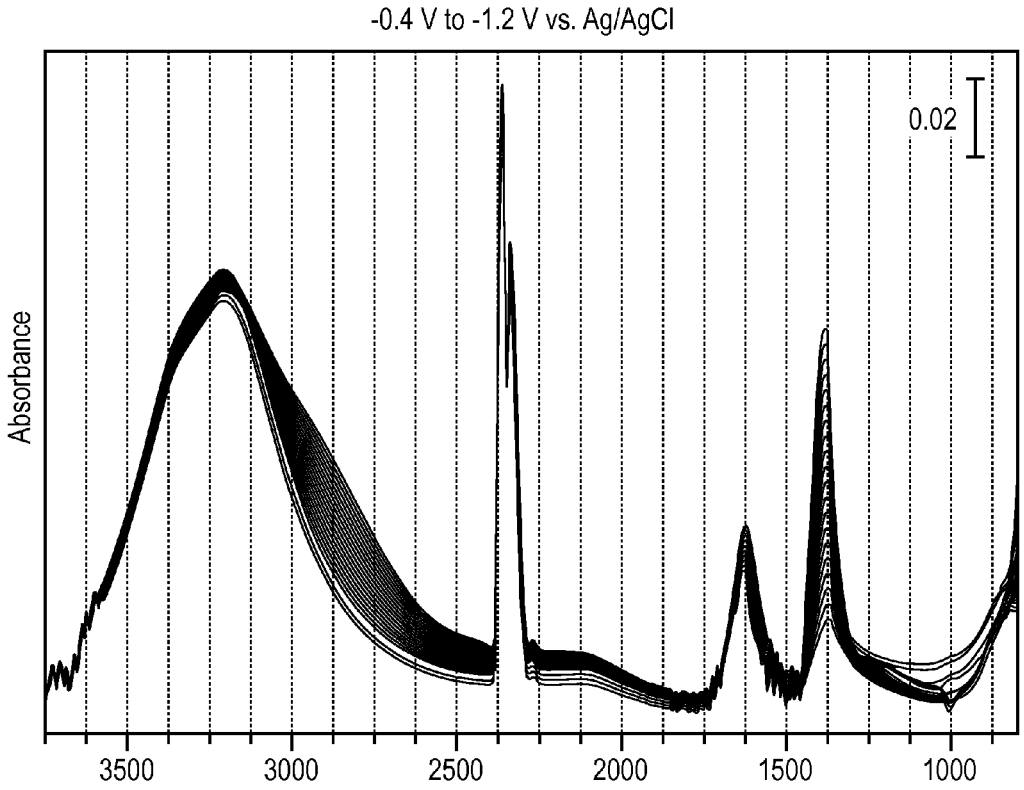
FIG. 4 shows the results of an in-situ FTIR study of Ag3Sn—SiOs CO2 electroreduction.
Figure 5:
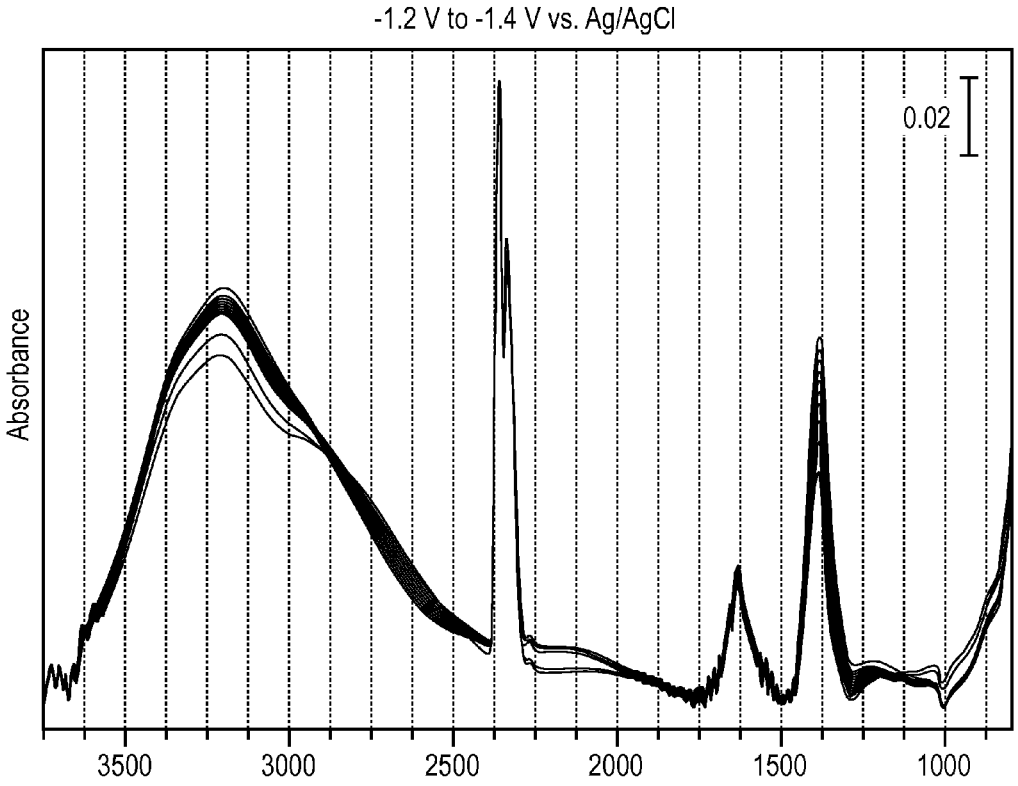
FIG. 5 shows the results of an in-situ FTIR study of Ag3Sn—SiOs CO2 electroreduction.
Figure 6:
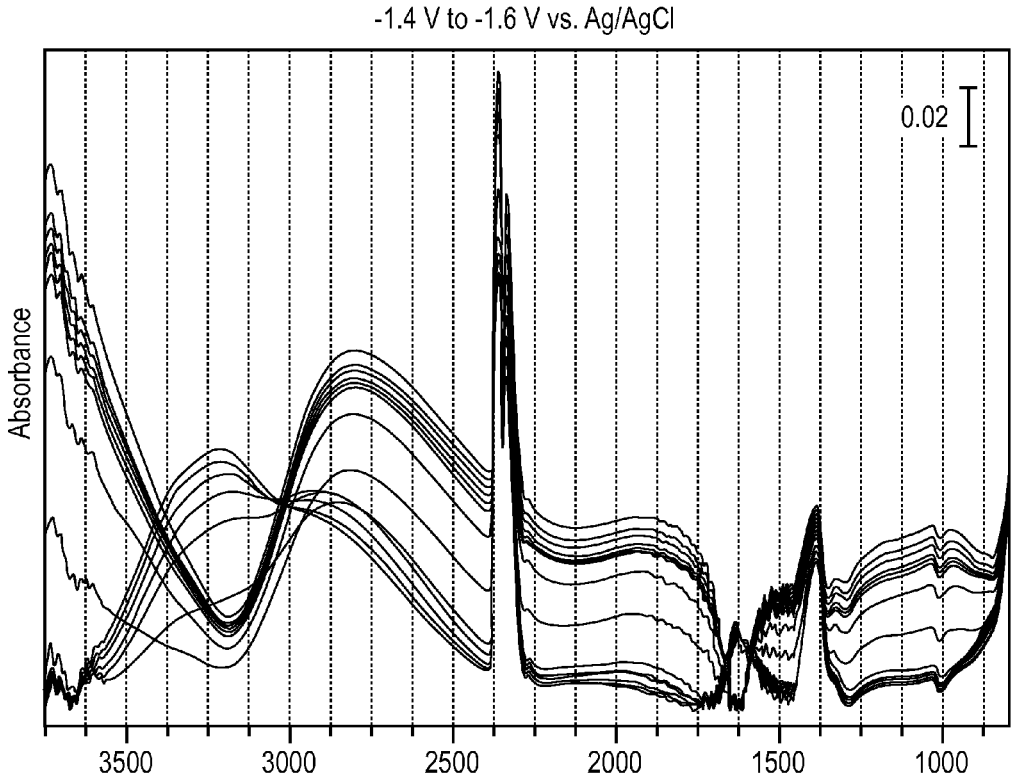
FIG. 6 shows the results of an in-situ FTIR study of Ag3Sn—SiOs CO2 electroreduction.
Figure 7:
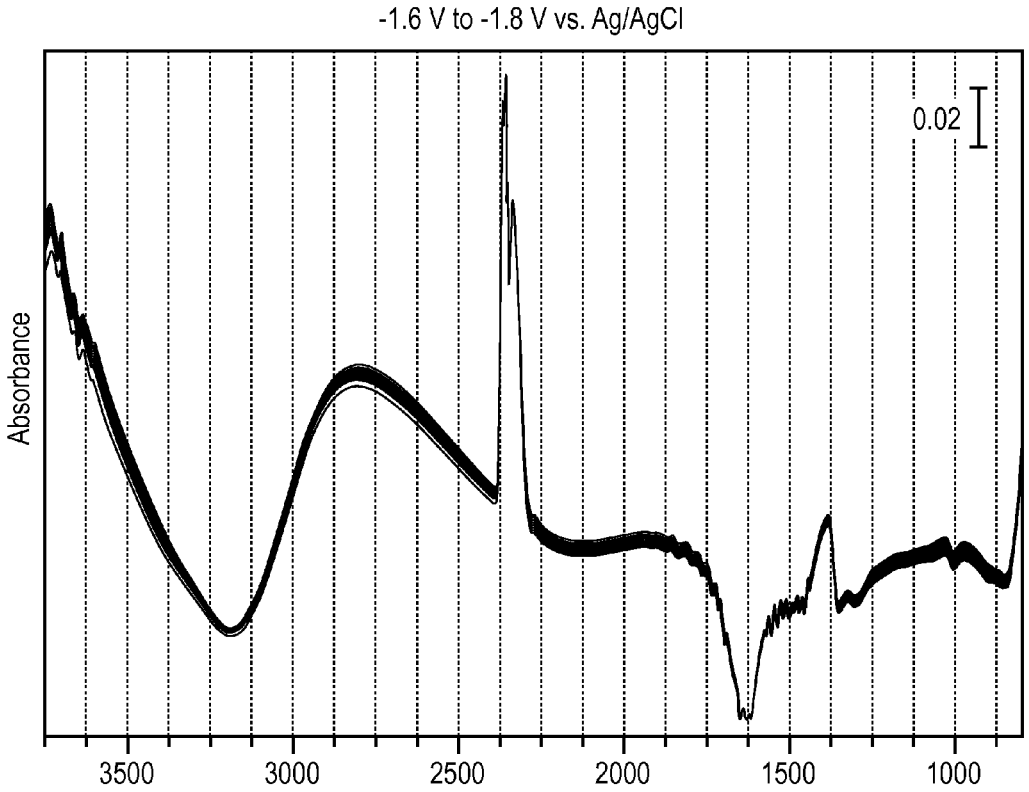
FIG. 7 shows the results of an in-situ FTIR study of Ag3Sn—SiOs CO2 electroreduction.

III. Synthesis of Ag3Sn Support 21.6 g of silver nitrate and 13.32 g of tin chloride dissolves in 500 ml of water. 13.5 g of silica is added to solution and dispersed using ultrasound bath. Mixture allows to dry at T=85 C for 4 hours, then T=115 for 24 hours. As prepared dry composite materials is ground and heat treated at hydrogen at T=600 C. The silica is removed by 4M KOH for 2 hours. As results catalyst powder was washed by DI water until neutral reaction and dried at T=85 C for 48 hours. FIG. 1 is a graph showing electroreduction on a variety of metal alloys including Ag3Sn prepared as described above. FIG. 3 is a cyclic voltammogram of Ag3Sn—SiO2. Conditions: 202 μg·cm−2 0.5 M NaCO3, 1600 RPM, 25° C., 20 mV·s−1. FIG. 4-7 show the results of an in-situ FTIR study of Ag3Sn—SiOs CO2 electroreduction. Conditions: 404 μg·$cm^2$, 0.5M NaOH, room temperature, CO2.

Figure 8:
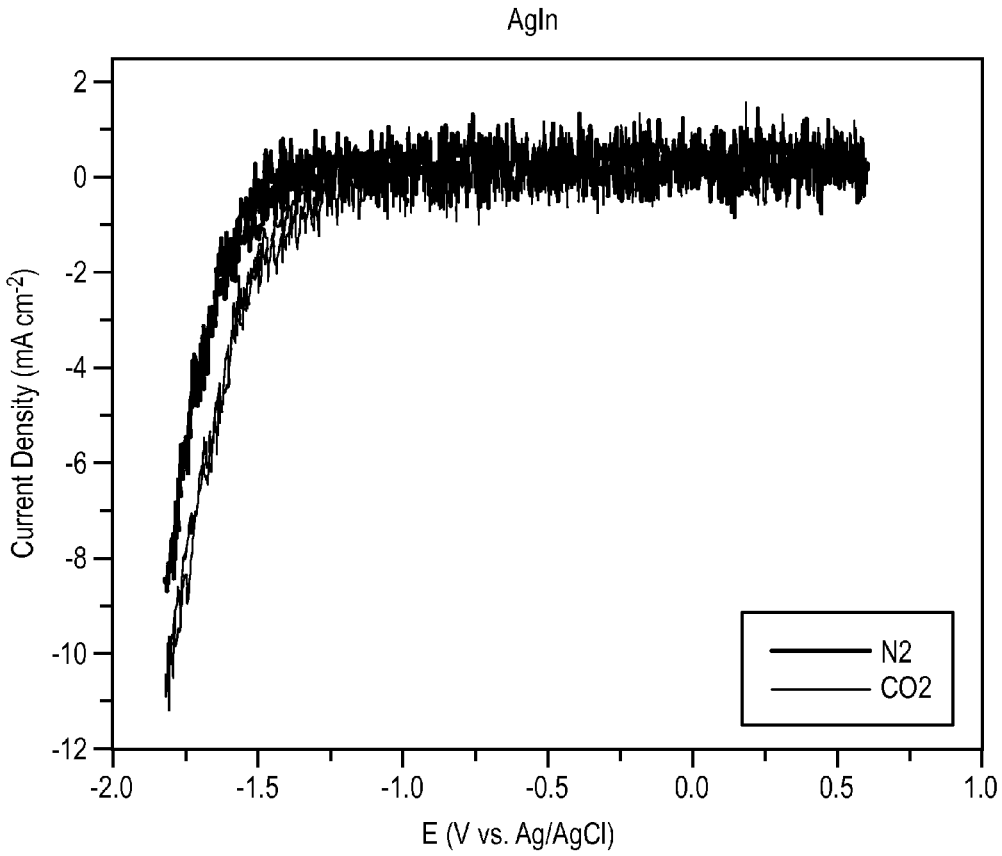
FIG. 8 is a cyclic voltammogram of AgIn.

IV. Synthesis of AgIn Support 32.8 g of silver nitrate and 33.87 g of indium chloride dissolves in 900 ml of water. 32.5 g of silica is added to solution and dispersed using ultrasound bath. Mixture allows to dry at T=50 C for 4 hours, then T=115 for 24 hours. As prepared dry composite materials is ground and heat treated at hydrogen at T=395 C. The silica is removed by 4M KOH for 2 hours. As results catalyst powder was washed by DI water until neutral reaction and dried at T=85 C for 48 hours. FIG. 1 is a graph showing electroreduction on a variety of metal alloys including AgIn prepared as described above. FIG. 8 is a cyclic voltammogram of AgIn. Conditions: 202 μg·$cm^{-2}$ 0.5 M $NaCO_3$, 1600 RPM, 25° C., 20 mV·$s^{-1}$.

Figure 9:
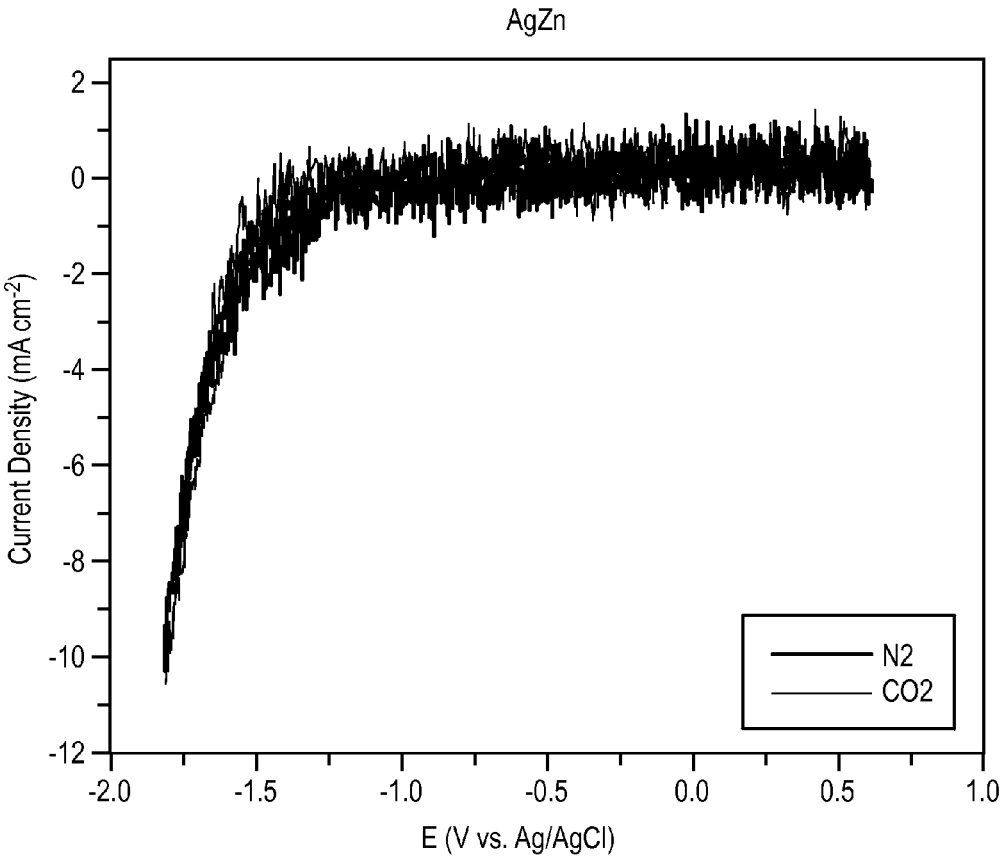
FIG. 9 is a cyclic voltammogram of AgZn.

V. Synthesis of AgZn Support 6.4 g of silver nitrate and 6.12 g of zinc nitrate dissolves in 200 ml of water. 9.5 g of silica is added to solution and dispersed using ultrasound bath. Mixture allows to dry at T=50 C for 4 hours, then T=115 for 24 hours. As prepared dry composite materials is ground and heat treated at hydrogen at T=455 C. The silica is removed by 4M KOH for 2 hours. As results catalyst powder was washed by DI water until neutral reaction and dried at T=85 C for 48 hours. FIG. 1 is a graph showing electroreduction on a variety of metal alloys including AgIn prepared as described above. FIG. 9 is a cyclic voltammogram of AgZn. Conditions: 202 μg·$cm^{-2}$ 0.5 M $NaCO_3$, 1600 RPM, 25° C., 20 mV·$s^{-1}$.

Figure 10:
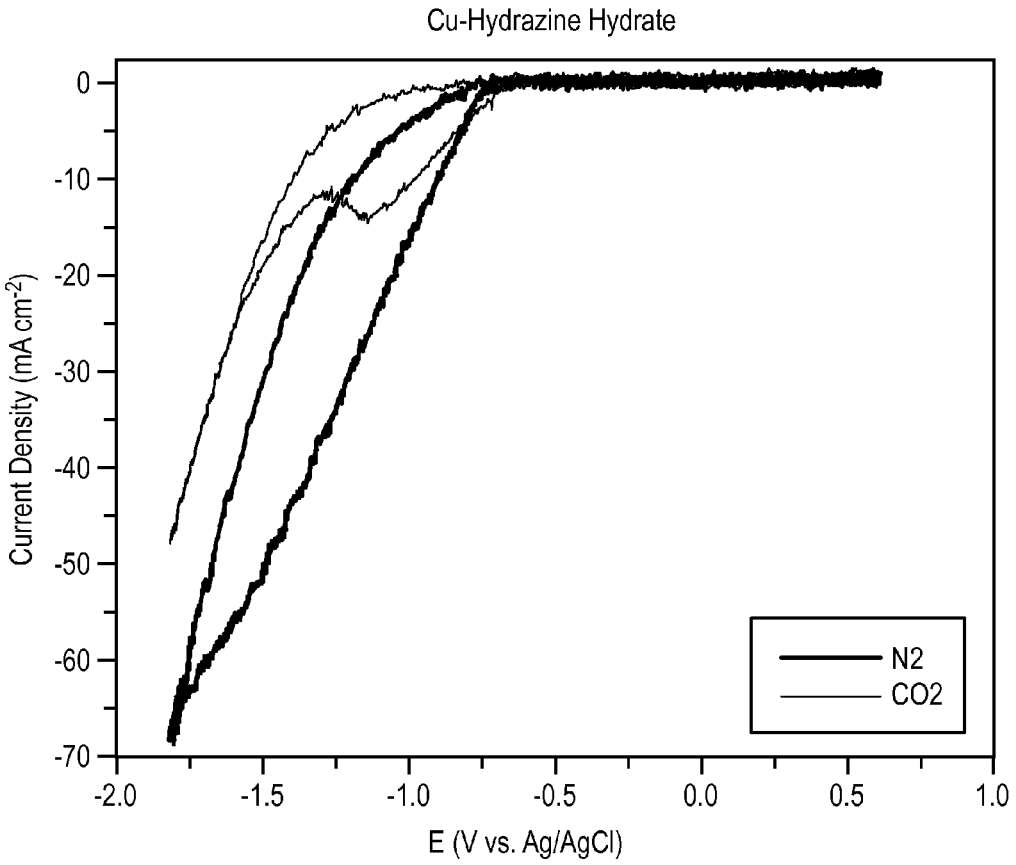
FIG. 10 is a cyclic voltammogram of Cu-hydrazine hydrate.
Figure 11:
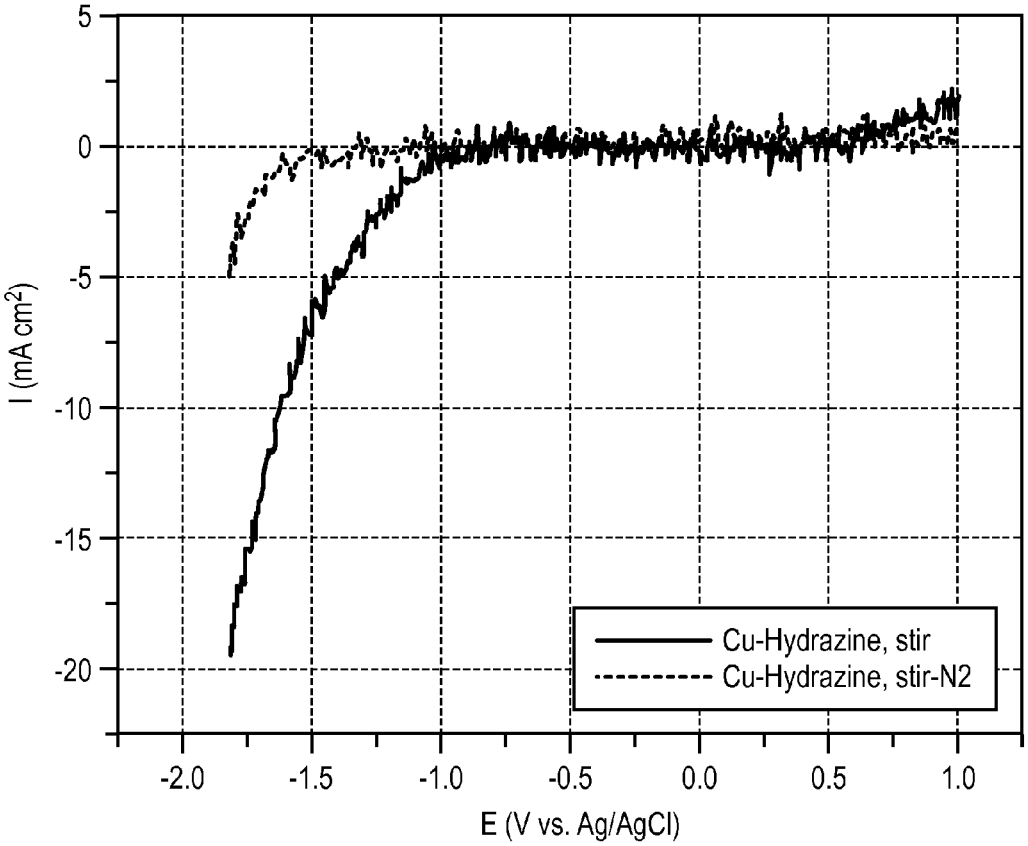
FIG. 11 is a graph showing electroreduction on Cu-hydrazine hydrate.
Figure 12:
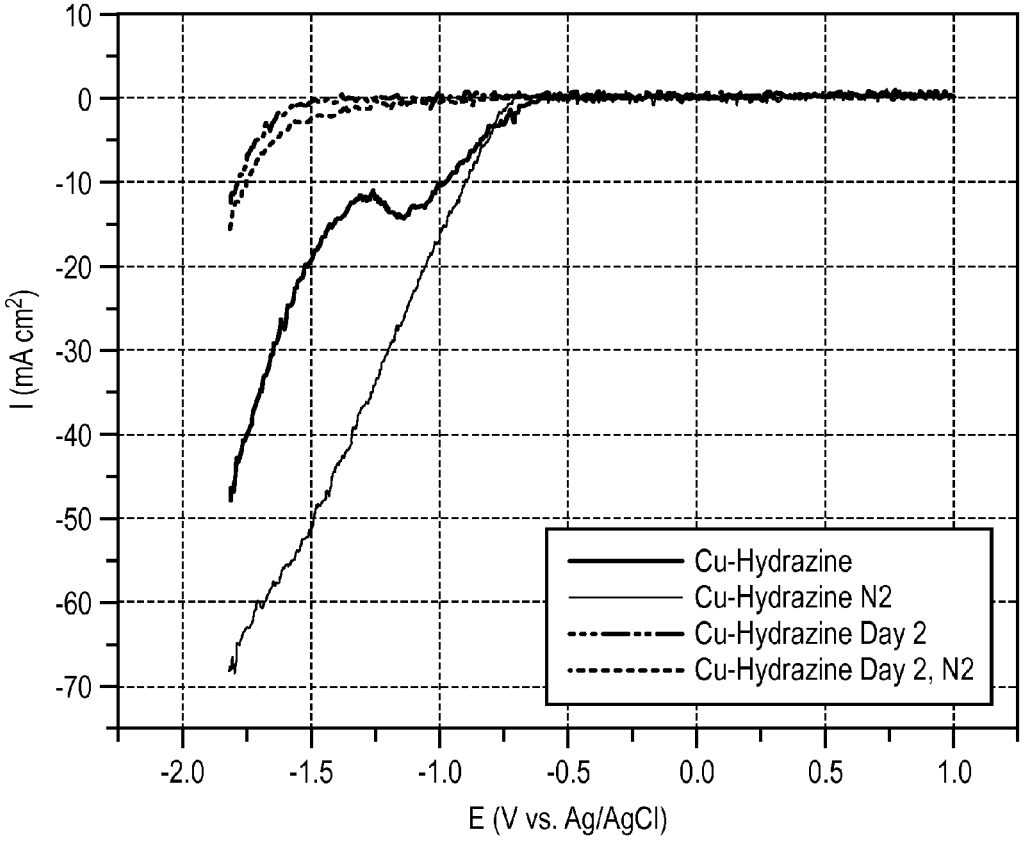
FIG. 12 is a graph showing electroreduction on Cu-hydrazine hydrate.

VII. Synthesis of Cu-Hydrazine Hydrate Support 12.4 g of copper nitrate were dissolved in 200 ml of water. 12.5 g of silica is added to solution and dispersed using ultrasound bath. 100 ml of $N_2H_4$*$H_2O_2$ were added to mixture. Mixture allows to dry at T=50 C for 4 hours, then T=115 for 24 hours. The silica is removed by 4M KOH for 2 hours. As results catalyst powder was washed by DI water until neutral reaction and dried at T=85 C for 48 hours. FIG. 10 is a cyclic voltammogram of Cu-hydrazine hydrate. Conditions: 202 μg·$cm^{-2}$ 0.5 M $NaCO_3$, 1600 RPM, 25° C., 20 mV·$s^{-1}$. FIGS. 11 and 12 are graphs showing electroreduction on Cu-hydrazine hydrate.

Figure 13:
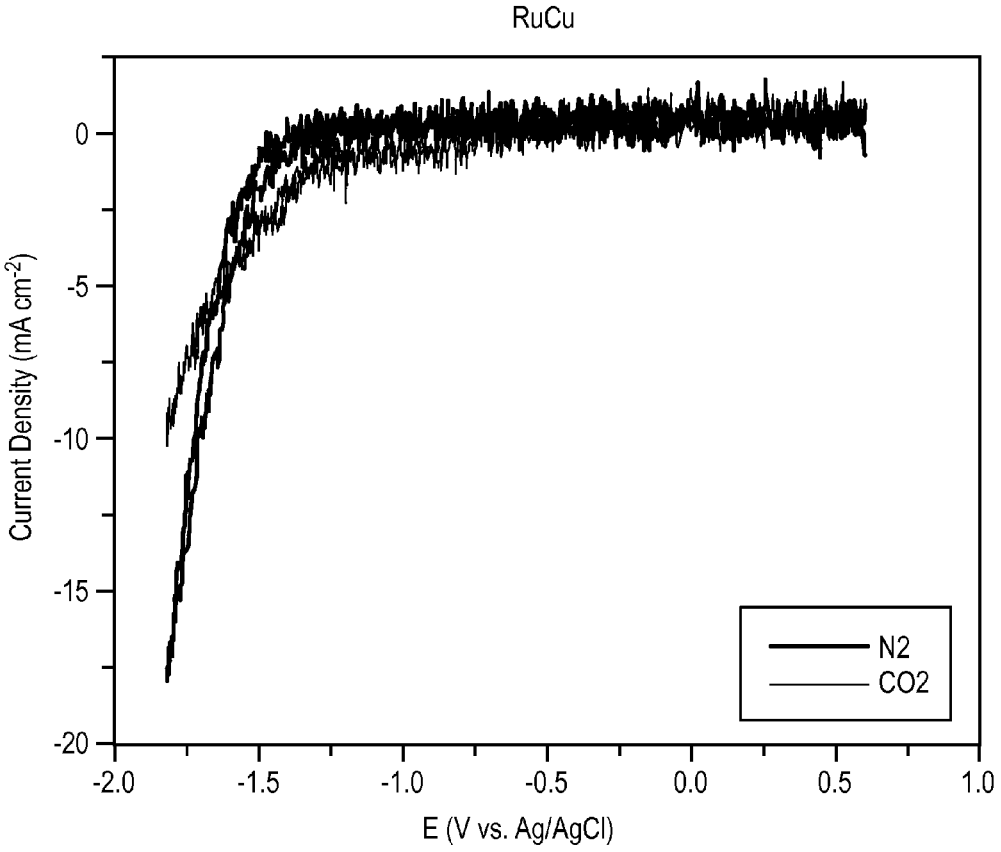
FIG. 13 is a cyclic voltammogram of RuCu.
Figure 14:
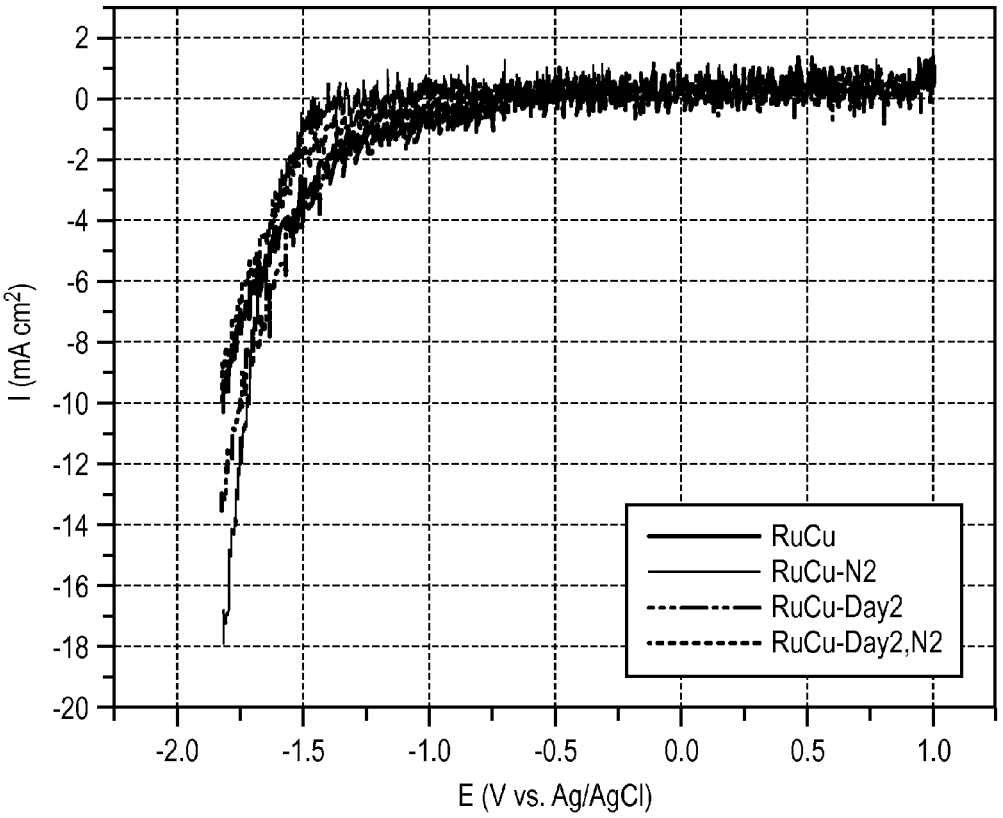
FIG. 14 is a graph showing electroreduction on RuCu.

X. Synthesis of RuCu Support 8.4 g of copper nitrate and 3.24 g of ruthenium chloride were dissolved in 500 ml of water. 12.5 g of silica is added to solution and dispersed using ultrasound bath. Mixture allows to dry at T=50 C for 4 hours, then T=115 for 24 hours. As prepared dry composite materials is ground and heat treated at hydrogen at T=350 C. The silica is removed by 4M KOH for 2 hours. As results catalyst powder was washed by DI water until neutral reaction and dried at T=85 C for 48 hours. FIG. 1 is a graph showing electroreduction on a variety of metal alloys including RuCu prepared as described above. FIG. 13 is a cyclic voltammogram of RuCu. 202 μg·$cm^{-2}$ 0.5 M $NaCO_3$, 1600 RPM, 25° C., 20 mV·$s^{-1}$. FIG. 14 is a graph showing electroreduction on RuCu.

What is claimed is:

1. A method for forming a porous material for electroreduction of $CO_2$, the method comprising:

mixing a first metal salt solution or dry powder and a plurality of individual non-aggregated sacrificial template particles such that the sacrificial template particles are dispersed within the solution or dry powder to form a mixture and enabling the mixture to form a dry composite material;

treating the dry composite material; and forming a plurality of voids by removing the sacrificial template particles to produce a porous metal or metal alloy material comprising the metal in the metal salt.

2. The method of claim 1 wherein the first metal salt comprises at least one of Ti, V, Cr, Mn, Fe, Co, Ni, Cu, Zn, Y, Zr, Nb, Mo, Ru, Rh, Pd, Ag, Cd, In, Sn, Sb, Hf, Ta, W, Os, Ir, Pt, Au, Tl, Pb, Bi, La, Ce, Pr, and Nd.

3. The method of claim 1 wherein the porous material consists of the metal in the metal salt.

4. The method of claim 1 further comprising mixing at least a second metal salt with the first metal salt and the sacrificial template particle so that the porous material comprises an alloy of the metals in the first and at least second metal salts.

5. The method of claim 4 wherein the second metal salt comprises at least one of Ti, V, Cr, Mn, Fe, Co, Ni, Cu, Zn, Y, Zr, Nb, Mo, Ru, Rh, Pd, Ag, Cd, In, Sn, Sb, Hf, Ta, W, Os, Ir, Pt, Au, Tl, Pb, Bi, La, Ce, Pr, and Nd, but is different from the metal in the first metal salt.

6. The method of claim 4 wherein the material consists of the metals in the metal salts.

7. The method of claim 1 wherein the sacrificial template particles are non-porous.

8. The method of claim 1 wherein the sacrificial template particles are between 5 and 40 nm in diameter.

9. The method of claim 1 wherein treating the dry composite material comprises heat treating the dry composite material.

10. The method of claim 1 wherein treating the dry composite material comprises decomposing the material.

11. The method of claim 1 wherein treating the dry composite material comprises reducing the material.

12. The method of claim 1 wherein the sacrificial template particles are irregularly and non-uniformly shaped, thereby resulting in a plurality of irregularly shaped and non-uniform voids.

13. A method for forming a supporting material for electroreduction of $CO_2$, the method comprising:

mixing a first metal salt and a plurality of sacrificial template particles and enabling the mixture to form a dry composite material;

treating the dry composite material;

removing the sacrificial template particles to produce a porous metal or metal alloy material comprising the metal in the metal salt; and grinding the dry composite material to form a powder.

14. The method of claim 13 wherein the powder comprises particles in the 1-500 nm size range.

15. A method for forming a supporting material for electroreduction of $CO_2$, the method comprising:

mixing a first metal salt and a plurality of sacrificial template particles and enabling the mixture to form a dry composite material;

treating the dry composite material; and removing the sacrificial template particles to produce a porous metal or metal alloy material comprising the metal in the metal salt;

wherein the method is performed without the use of solvents.

16. A method for forming a supporting material for electroreduction of $CO_2$, the method comprising:

mixing via mechanosynthesis a first metal salt and a plurality of sacrificial template particles and enabling the mixture to form a dry composite material;

treating the dry composite material;

removing the sacrificial template particles to produce a porous metal or metal alloy material comprising the metal in the metal salt; and grinding the dry composite material to form a powder.

17. The method of claim 16 wherein the mechanosynthesis means includes ball milling.

* * * * *